US008237694B2

(12) United States Patent
Tung et al.

(10) Patent No.: US 8,237,694 B2
(45) Date of Patent: Aug. 7, 2012

(54) METHOD AND CIRCUIT FOR CONTROLLING TIMINGS OF DISPLAY DEVICES USING A SINGLE DATA ENABLE SIGNAL

(75) Inventors: Chia-Hsin Tung, Hsinchu (TW); Wing-Kai Tang, Hsinchu (TW); Wei-Yi Wei, Nantou County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 793 days.

(21) Appl. No.: 12/418,615

(22) Filed: Apr. 6, 2009

(65) Prior Publication Data

US 2010/0177067 A1 Jul. 15, 2010

(30) Foreign Application Priority Data

Jan. 14, 2009 (TW) ..... 98101202 A

(51) Int. Cl.
*G09G 5/00* (2006.01)

(52) U.S. Cl. ..... 345/204; 345/213; 345/214; 345/691

(58) Field of Classification Search ..... 345/204, 345/212, 213, 214, 691, 692, 693, 694, 18, 345/28, 29

See application file for complete search history.

(56) References Cited

U.S. PATENT DOCUMENTS

| | | | | |
|---|---|---|---|---|
| 5,945,983 | A * | 8/1999 | Kanno et al. | 345/204 |
| 6,636,205 | B1 * | 10/2003 | Lasneski | 345/204 |
| 7,038,673 | B2 * | 5/2006 | Lee et al. | 345/211 |
| 7,554,534 | B2 * | 6/2009 | Takaki et al. | 345/204 |
| 7,649,530 | B2 * | 1/2010 | Takeda | 345/213 |
| 7,898,539 | B2 * | 3/2011 | Bae et al. | 345/213 |
| 8,085,227 | B2 * | 12/2011 | Ezaki et al. | 345/82 |

* cited by examiner

*Primary Examiner* — Duc Dinh

(74) *Attorney, Agent, or Firm* — Winston Hsu; Scott Margo

(57) ABSTRACT

In a first display period of a display device, a first count value is recorded at the rising edge of the data enable signal for controlling the length of a horizontal line. Next, a second count value is recorded at the falling edge of the data enable signal for identifying the time when the data enable signal switches from a high level to a low level. When entering a porch period following the first display period, the counter is cleared when the count value reaches the first count value. In a second display period following the porch period, the counter is cleared at the rising edge of the data enable signal, and the first count value is used for controlling the length of the horizontal line.

12 Claims, 4 Drawing Sheets

METHOD AND CIRCUIT FOR CONTROLLING TIMINGS OF DISPLAY DEVICES USING A SINGLE DATA ENABLE SIGNAL

BACKGROUND OF THE INVENTION

1. Field of the Invention

The present invention relates to a method and circuit for controlling timings of display devices using a single data enable signal, and more particularly, to a method and circuit for controlling timings in the porch period of display devices using a single data enable signal.

2. Description of the Prior Art

Display systems can receive image frames contained in video signals via transmission channels. After signal processing, static or dynamic images can be displayed on a screen. Display systems normally adopt GTF (Generalized Timing Formula) standard proposed by VESA (Video Electronics Standards Association), and can be categorized into analog or digital display systems based on the formats of image data.

Traditional cathode ray tube (CRT) devices are analog display systems which operate based on the vision persistence perceived by human eyes. In CRT devices, the image data of an entire frame is not displayed simultaneously on the screen. Instead, image signals are segmented and then scanned sequentially. The first scan starts from one end of a horizontal line to the other end, followed by the second scan starting from one end of the next horizontal line to the other end, and similar operations continue for subsequent scans. In the timing control of the CRT device, a frame signal includes horizontal signals and vertical signals. The horizontal signals include the data signal of each horizontal line, the front porch signal, the horizontal synchronization signal and the back porch signal. The front porch and back porch signals do not carry any data and can provide the CRT device with sufficient time when moving between the start points of different scans. Similarly, the vertical signals include the front porch signal, the vertical synchronization signal and the back porch signal, and provide the same functions as the horizontal signals.

Liquid crystal display (LCD) devices are digital systems characterized in low radiation, small size and low power consumption. Therefore, LCD devices have gradually replaced traditional CRT devices, and are widely used in various electronic products, such as laptop computers, personal digital assistants (PDAs), flat-panel TVs, or mobile phones. In an LCD device, a gate driver transmits scan signals to the scan lines of the display panel for controlling the switches of each pixel, while a source driver transmits image data (such as red, green and blue signals) to the data lines of the display panel for driving the pixels. Due to different structures, the CRT device requires sufficient time for moving the CRT to the correct locations, while the LCD device needs to control the switch turn-on time and the delay of data transmission. Normally, the LCD devices also follow VESA standards when performing internal image-processing and timing control. For example, the horizontal synchronization signal is used for identifying the start points of each horizontal line, while the vertical synchronization signal is used for identifying the start points of each frame.

FIG. 1 is a timing diagram illustrating a prior art method for controlling timings of an LCD device. FIG. 1 shows a vertical synchronization signal Vsync, a horizontal synchronization signal Hsync, a data enable signal DE, and a pixel signal PX. In the display period TD of the LCD device, the vertical synchronization signal Vsync, the horizontal synchronization signal Hsync and the data enable signal DE remain at high voltage level, and image data can be written into corresponding pixels. In the porch period TP of the LCD device, the data enable signal DE remains at low voltage level, and no image data is written into the pixels. Meanwhile, the vertical synchronization signal Vsync and the horizontal synchronization signal Hsync are used for controlling the synchronization between other control signals in the porch period TP.

FIG. 2 is a timing diagram illustrating another prior art method for controlling timings of an LCD device. FIG. 2 shows a data enable signal DE, a pixel data signal PX, and a count value LC. The method illustrated in FIG. 2 can be applied to LCD devices in which no external vertical synchronization signal Vsync nor horizontal synchronization signal Hsync is applied during the porch period TP. Without Vsync and Hsync, this prior art method controls timings in the porch period TP using a single data enable signal DE. At the rising edge of the data enable signal DE, the value of a line counter is reset after timing information is recorded so that the LCD device can perform other functions during the porch period TP based on the recorded count value. However, when the LCD device exits the porch period TP and re-enters the display period TD, deviations (as indicated by Δt in FIG. 1) may occur to the data enable signal DE, thereby affecting the synchronization between the data enable signal DE and internal frames.

SUMMARY OF THE INVENTION

The present invention provides a method for controlling timings of a display device using a single data enable signal, comprising recording a first count value of a counter at a rising edge of a data enable signal in a first display period of a display device for controlling a length of a horizontal line, and resetting a value of the counter after having recorded the first count value; recording a second count value of the counter at a falling edge of the data enable signal in the first display period for identifying a time when the data enable signal switches from a high level to a low level in the first display period; after entering a porch period subsequent to the first display period, resetting the value of the counter when the value of the counter reaches the first count value; and at the rising edge of the data enable signal in a second display period subsequent to the porch period, resetting the value of the counter and controlling the length of the horizontal line in the second display period based on the first count value.

The present invention also provides a timing controller circuit for controlling timings of a display device using a single data enable signal, comprising a counting means for recording corresponding count values in a first display period, in a porch period subsequent to the first display period and in a second display period subsequent to the porch period and capable of restarting counting after receiving a reset signal; a recording means for recording a first count value of the counter at a rising edge of a data enable signal and a second count value of the counter at a falling edge of the data enable signal in the first display period; a control means for providing the reset signal after recording the first count value, for providing the reset signal when the value of the counter reaches the first count value after entering the porch period, and for providing the reset signal at the rising edge of the data enable signal in the second display period; and a signal generating means for providing the data enable signal and for controlling a length of a horizontal line in the first and second display periods based on the first count value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
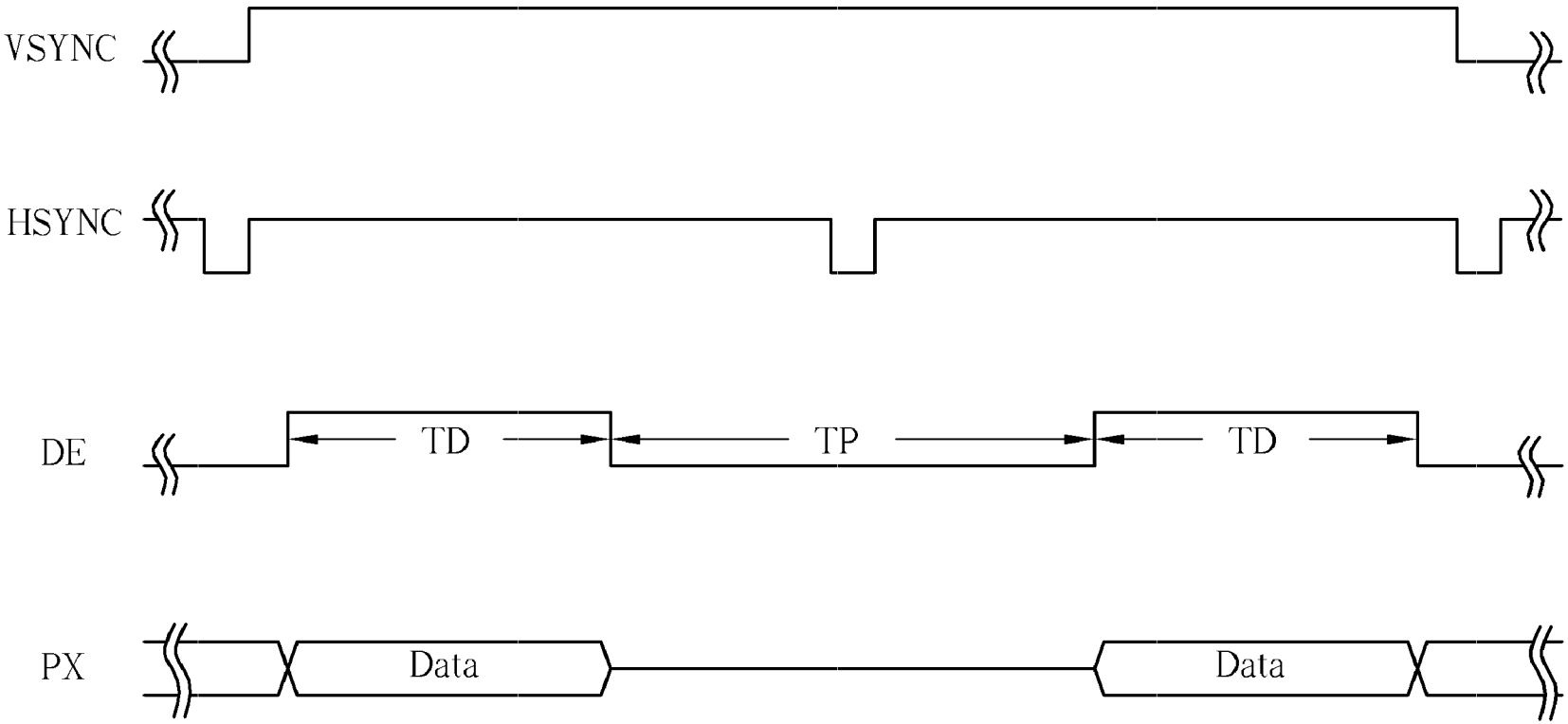
FIG. 1 PRIOR ART
FIG. 1 is a timing diagram illustrating a prior art method for controlling timings of an LCD device.
Figure 2:
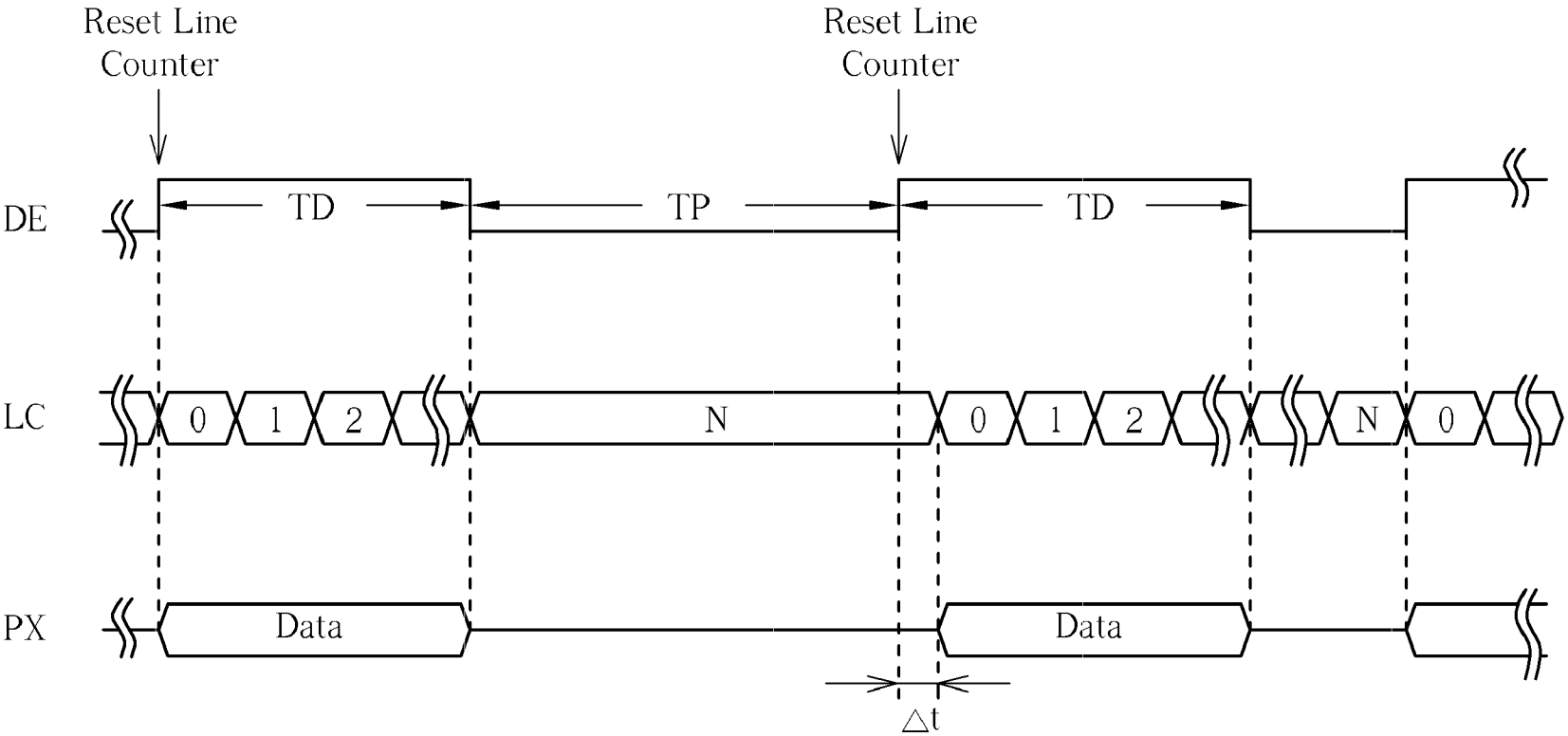
FIG. 2 PRIOR ART
FIG. 2 is a timing diagram illustrating another prior art method for controlling timings of an LCD device.
Figure 3:
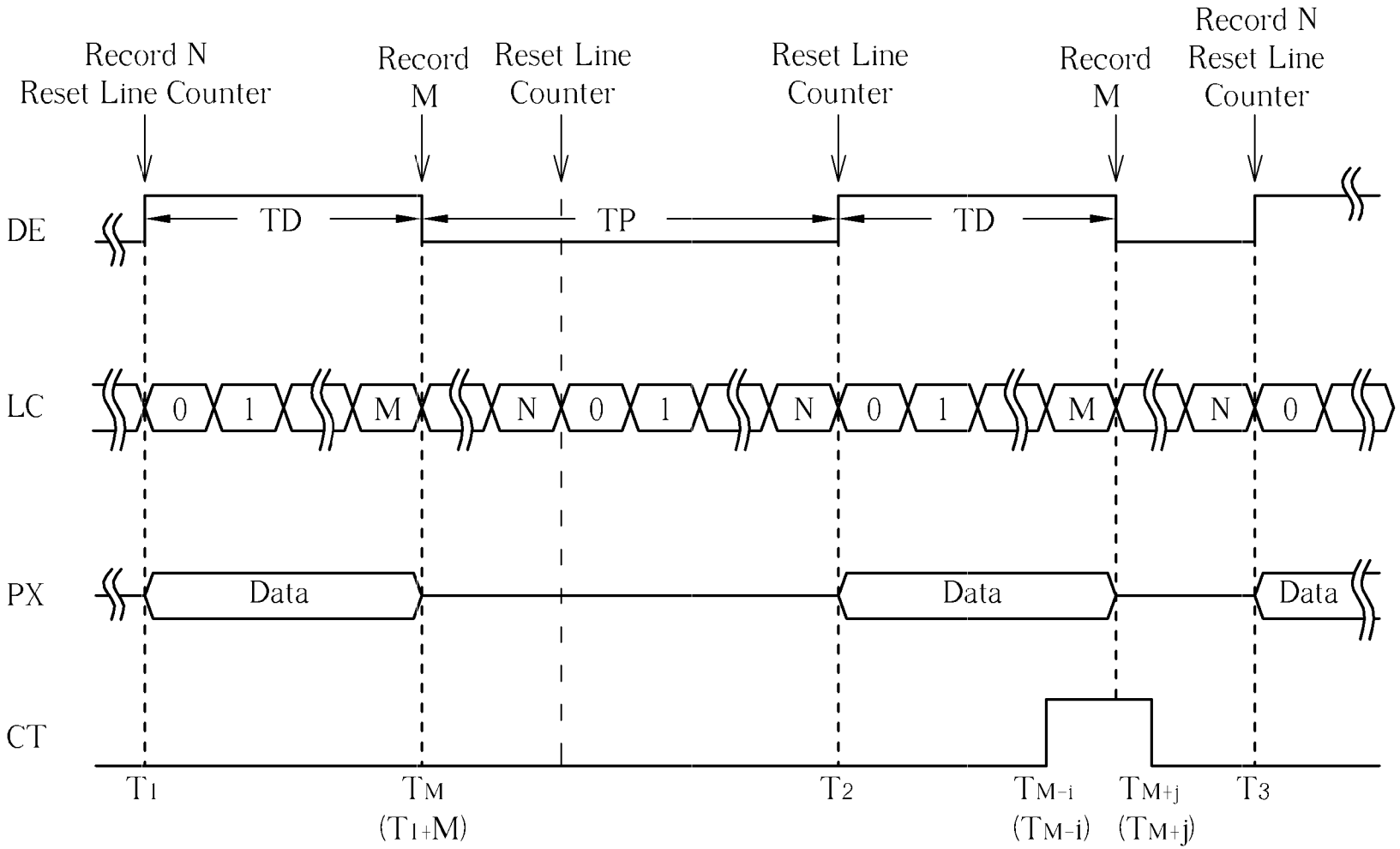
FIG. 3 is a timing diagram illustrating a method for controlling timings of an LCD device according to the present invention.

FIG. 3 is a timing diagram illustrating a method for controlling timings of an LCD device according to the present invention. FIG. 3 shows a data enable signal DE, a pixel signal PX, a count value LC, and a control signal. For LCD devices without external vertical synchronization signal Vsync and horizontal synchronization signal Hsync during the porch period, the present invention controls timings using a single data enable signal DE. Timing information is recorded at the rising edge and the falling edge of the data enable signal DE for providing timing control signals in the display period or the porch period. The method for recording timing information will be explained in detail in subsequent paragraphs.

At T1 of the display period TD, a count value N of a line counter is recorded at the rising edge of the data enable signal DE for controlling the length of a horizontal line. After recording the count value N, the line counter is reset and restarts counting.

Next, at $T_M$ of the display period TD (T1+M), a count value M of the line counter is recorded at the falling edge of the data enable signal DE. The count value M identifies the time when the data enable signal DE switches from a high level to a low level, and can be used as a reference for generating internal timing signals. For example, if the control signal CT is inputted for performing other operations during the porch period TP, the start point $T_{M-1}$ ($T_M$−i) and the end point $T_{M+j}$ ($T_M$+j) of the control signal CT can be determined based on the count value M.

After entering the porch period TP, the line counter is reset and then restarts counting once its value reaches the count value N. However, the recorded count value N is not modified during this period. In other words, the present invention maintains the timings in the porch period based on the count value previously recorded at the rising edge of the data enable signal DE.

The LCD device exits the porch period TP at T2, and then re-enters the display period TD. During this period, the line counter is reset at the rising edge of the data enable signal DE. The line counter restarts counting after being reset, but the recorded count value N is not modified. When the LCD device switches from the porch period TP to the display period TD, the data enable signal DE may deviate or the timings in the porch period are not properly maintained by an external system. Under these circumstances, the present invention can still maintain the proper timings based on the correct count value.

Last, at each rising edge of the data enable signal DE in the subsequent display periods TD (such as at T3), new count values N of the line counter are recorded for controlling the length of horizontal lines in the subsequent display periods TD. The line counter is reset after recording the count values N, and then restarts counting.

Figure 4:
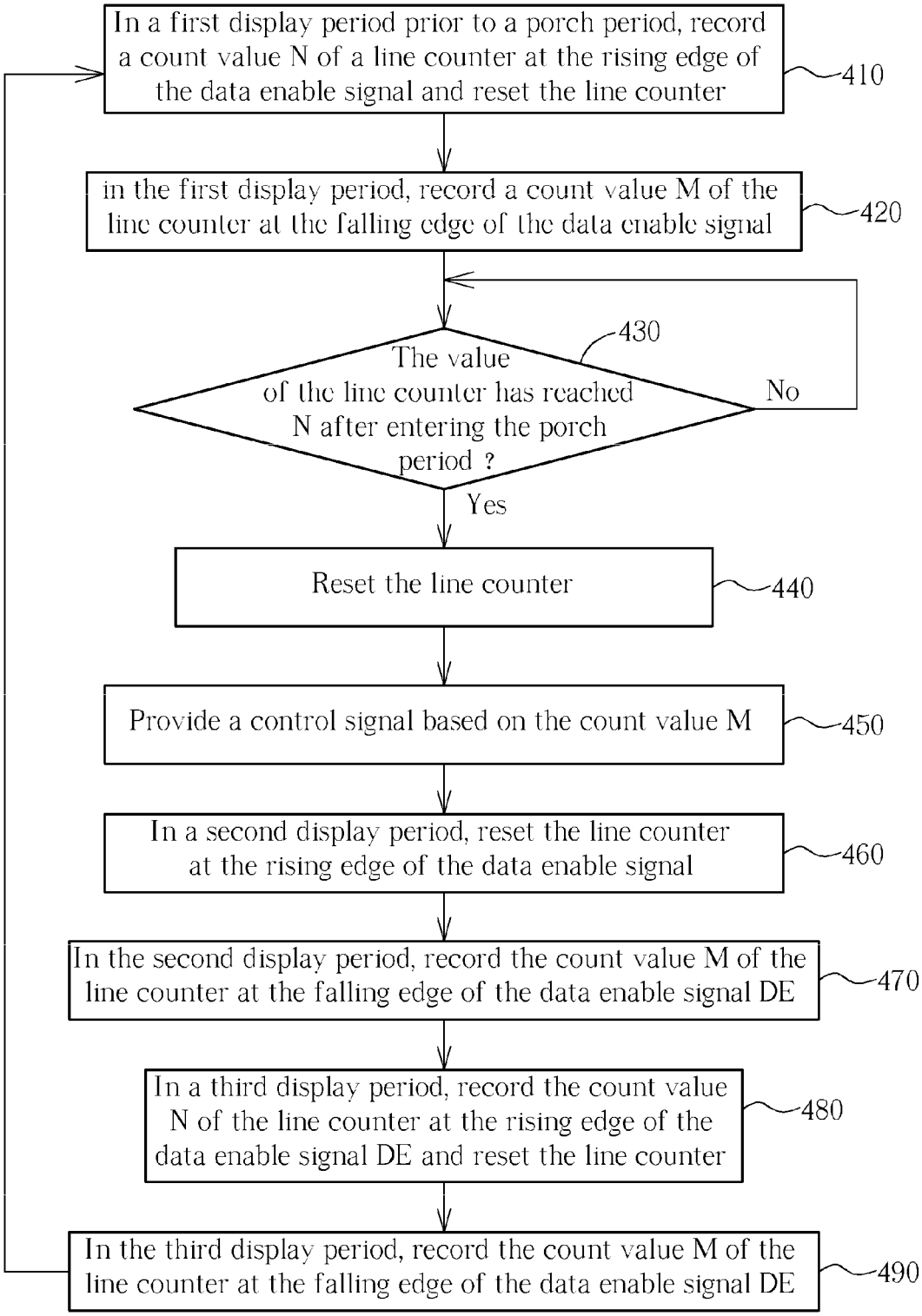
FIG. 4 is a flowchart illustrating a method for controlling timings of an LCD device using a single data enable signal DE according to the present invention.

Reference is made to FIG. 4 for a flowchart illustrating a method for controlling timings of an LCD device using a single data enable signal DE according to the present invention. The flowchart in FIG. 4 includes the following steps:

Step 410: in a first display period prior to a porch period, record a count value N of a line counter at the rising edge of the data enable signal DE for controlling the length of a horizontal line, and reset the line counter to restart counting;

Step 420: in the first display period, record a count value M of the line counter at the falling edge of the data enable signal DE for identifying the time when the data enable signal DE switches from a high level to a low level in the first display period;

Step 430: determine if the value of the line counter has reached N after entering the porch period: if the value of the line counter has reached N, execute step 440; if the value of the line counter has not reached N, execute step 430;

Step 440: reset the line counter to restart counting;

Step 450: provide a control signal based on the count value M;

Step 460: in a second display period subsequent to the porch period, reset the line counter at the rising edge of the data enable signal DE to restart counting, and control the length of the horizontal line based on the count value N;

Step 470: in the second display period, record the count value M of the line counter at the falling edge of the data enable signal DE for identifying when the data enable signal DE switches from a high level to a low level in the first display period;

Step 480: in a third display period subsequent to the second display period, record the count value N of the line counter at the rising edge of the data enable signal DE for controlling the length of the horizontal line in the third display period, and reset the line counter to restart counting;

Step 490: in the third display period, record the count value M of the line counter at the falling edge of the data enable signal DE for identifying the time when the data enable signal DE switches from a high level to a low level in the first display period; execute step 410.

Those skilled in the art will readily observe that numerous modifications and alterations of the device and method may be made while retaining the teachings of the invention.

What is claimed is:

1. A method for controlling timings of a display device using a single data enable signal, comprising:

recording a first count value of a counter at a rising edge of a data enable signal in a first display period of a display device for controlling a length of a horizontal line, and resetting a value of the counter after having recorded the first count value;

recording a second count value of the counter at a falling edge of the data enable signal in the first display period for identifying a time when the data enable signal switches from a high level to a low level in the first display period;

after entering a porch period subsequent to the first display period, resetting the value of the counter when the value of the counter reaches the first count value; and at the rising edge of the data enable signal in a second display period subsequent to the porch period, resetting the value of the counter and controlling the length of the horizontal line in the second display period based on the first count value.

2. The method of claim 1 further comprising:

recording the value of the counter at the falling edge of the data enable signal in the second display period for identifying the time when the data enable signal switches from the high level to the low level in the second display period.

3. The method of claim 2 further comprising:

at the rising edge of the data enable signal in a third display period subsequent to the second display period, recording a third count value of the counter for controlling the length of the horizontal line in the third display period, and resetting the value of the counter after having recorded the third count value.

4. The method of claim 2 further comprising:

providing timings for a control signal in the porch period based on the second count value.

5. The method of claim 2 wherein recording and resetting the value of the counter comprises recording and resetting the value of a line counter.

6. The method of claim 1 further comprising:

determining whether the value of the counter reaches the first count value.

7. A timing controller circuit for controlling timings of a display device using a single data enable signal, comprising:

a counting means for recording corresponding count values in a first display period, in a porch period subsequent to the first display period and in a second display period subsequent to the porch period and capable of restarting counting after receiving a reset signal;

a recording means for recording a first count value of the counter at a rising edge of a data enable signal and a second count value of the counter at a falling edge of the data enable signal in the first display period;

a control means for providing the reset signal after recording the first count value, for providing the reset signal when the value of the counter reaches the first count value after entering the porch period, and for providing the reset signal at the rising edge of the data enable signal in the second display period; and a signal generating means for providing the data enable signal and for controlling a length of a horizontal line in the first and second display periods based on the first count value.

8. The timing controller circuit of claim 7 wherein the recording means further records the value of the counter at the falling edge of the data enable signal in the second display period for identifying a time when the data enable signal switches from a high level to a low level in the second display period.

9. The timing controller circuit of claim 7 wherein:

the recording means further records a third count value of the counter at the rising edge of the data enable signal in a third display period subsequent to the second display period;

the signal generating means further controls the length of the horizontal line in the third display period based on the third count value; and the control means further provides the reset signal after the third count value is recorded.

10. The timing controller circuit of claim 7 wherein the signal generating means further provides timings for a control signal in the porch period based on the second count value.

11. The timing controller circuit of claim 7 wherein the counting means includes a line counter.

12. The timing controller circuit of claim 7 further comprising:

a judging means for determining whether the value of the counter reaches the first count value in the porch period.

* * * * *